US007561061B2

(12) United States Patent
Lee et al.

(10) Patent No.: US 7,561,061 B2
(45) Date of Patent: Jul. 14, 2009

(54) MONITOR WITH REMINDER SOUND

(75) Inventors: Yueh-Huah Lee, Taipei (TW); Yaw-Huei Chiou, Taipei (TW)

(73) Assignee: Asustek Computer Inc., Taipei (TW)

( * ) Notice: Subject to any disclaimer, the term of this patent is extended or adjusted under 35 U.S.C. 154(b) by 334 days.

(21) Appl. No.: 11/516,480

(22) Filed: Sep. 7, 2006

(65) Prior Publication Data

US 2007/0096926 A1 May 3, 2007

(30) Foreign Application Priority Data

Oct. 31, 2005 (TW) ..... 94138148 A

(51) Int. Cl.
*G08B 25/08* (2006.01)

(52) U.S. Cl. ..... 340/692; 340/691.1; 340/691.6; 348/177; 348/179; 348/181; 348/184

(58) Field of Classification Search ..... 340/691.1, 340/691.7, 692
See application file for complete search history.

(56) References Cited

U.S. PATENT DOCUMENTS 6,556,255 B1 * 4/2003 Kim et al. ..... 348/734
7,028,042 B2 * 4/2006 Rissanen ..... 707/101
2007/0080845 A1 * 4/2007 Amand ..... 341/176

* cited by examiner

*Primary Examiner*—Daniel Wu
*Assistant Examiner*—Son M Tang
(74) *Attorney, Agent, or Firm*—Rosenberg, Klein & Lee

(57) ABSTRACT

A monitor with reminder sounds is disclosed. The device includes at least a monitor, at least a button and an audio player. The button is disposed on the monitor for adjusting status of the monitor. The audio player is also arranged on the monitor and is connected with the button. When pressing the button, the audio player receives a signal and makes a sound. The monitor further includes a detection module that is used to check output image signals of the monitor. When detecting errors of output image signals of the monitor, the detection module sends a detection signal to the audio player so as to make the audio player generate a sound. Thus the user is reminded that whether the button is pressed precisely. Furthermore, the device also informs the user is that the monitor is in abnormal status. Therefore, the present invention provides users more convenience of use.

17 Claims, 4 Drawing Sheets

MONITOR WITH REMINDER SOUND

BACKGROUND OF THE INVENTION

The present invention relates to a monitor, especially to a monitor with reminder sounds.

By an increasing advancement and development of information technology, electronic products are updated rapidly in order to satisfy different requirements of people. Take a monitor as an example most of the monitors is CRT monitor in early days. Due to large volume, high power consumption, and radiation emission that may damage users' eyes after long-term use, the CRT monitors are gradually replaced by liquid crystal display (LCD) monitors. The LCD monitors has advantages of light weight, space saving, low radiation and low power consumption and thus becomes the mainstream on the market.

Moreover, refer to buttons on electronic products. In early days, most of the buttons is objective so that users need to apply force on the button for use. Due to different ways and strength of applying force, users may apply improper force or press the button for a long time. Thus not only the button becomes insensitive, the buttons as well as the electronic products are easy to get damage. Therefore, research and development staffs have invented a touch sensor button, replacing conventional substantial button. The probability of the button to damage is reduced, the appearance of the products is more esthetic, and the device brings users more convenience of use.

Furthermore, monitors with touch sensor buttons are available now. Users only need to tap the touch sensor button easily for adjusting settings of the monitor. Sometimes users may touch the button with insufficient force, they need to press again. This makes users inconvenient. Sometimes, when users touch the touch-control button without any response immediately, they may press the button repeatedly. This causes users inconvenience.

In addition, monitors may get damage or defect due to long-term use or inadequate operation. This leads to errors in signal input or output of the monitor or no image displayed on the monitor. Some users don't know how to deal with such condition so that they may behave weirdly such as knock the monitor or continuously press buttons on monitors. Thus not only the buttons are easy to get damage but the probability of damage of the monitors is reduced.

SUMMARY OF THE INVENTION

It is therefore a primary object of the present invention to provide a monitor with reminder sounds that displays warning signal while users press a button of the monitor for informing users and checking whether they press the button intentionally or accidentally. Thus the monitor is more convenient to use.

It is another object of the present invention to provide a monitor with reminder sounds that detects wrong output signal generated from the monitor by the detection module and produces warning sounds by the audio player to inform the user to learn the abnormal status of the monitor.

In order to achieve above objects, the embodiment of the present invention includes a monitor, at least a button, and an audio player. The button and the audio player are disposed on the monitor. The button, corresponding to functions of the monitor, is used to adjust the status of monitor and is connected to the audio player. When users press the button, the button initiates the monitor after receiving a touch signal and sends out a signal to the audio player so as to make the audio player generate sounds. According the embodiment of the present invention, the monitor further includes a detection module that detects an output image signal. When it detects an error in the output image signal, the detection module sends a detection signal to the audio player so as to make the audio player produce the warning sounds. Besides assisting and informing users to learn whether the button is pressed precisely, the warning signal warns the users that there is error on output signal of the monitor.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
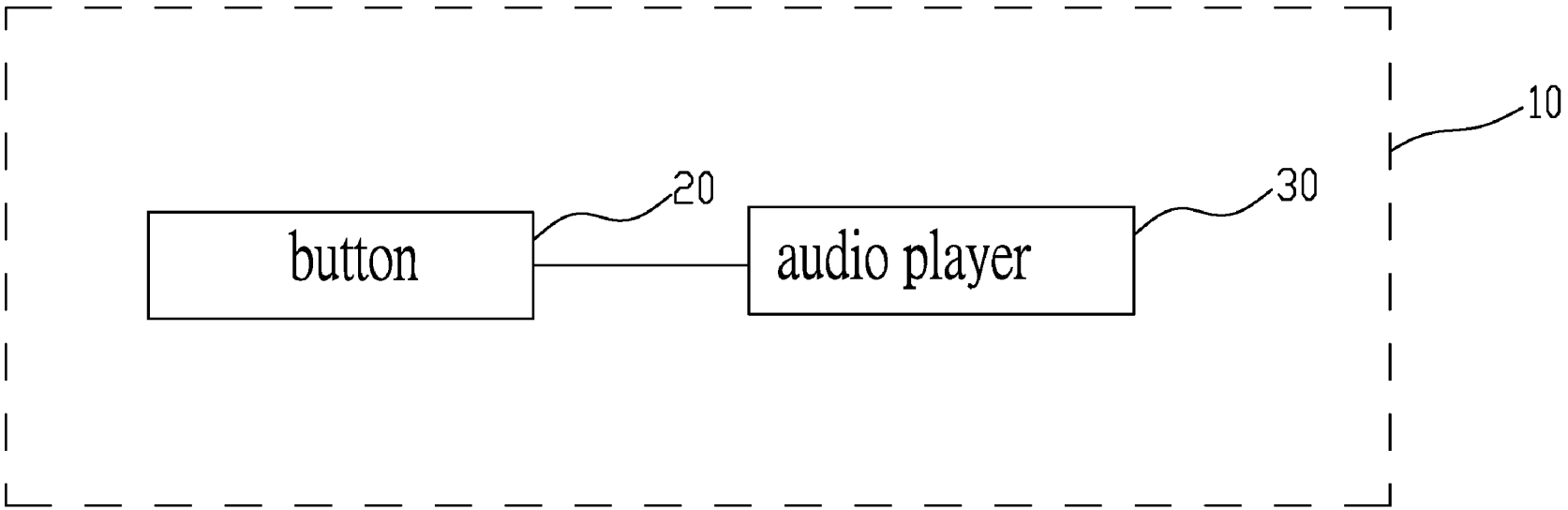
FIG. 1 is a block diagram of an embodiment in accordance with the present invention.

Refer to FIG. 1, a monitor with reminder sounds according to the present invention consists of a monitor 10, at least a button 20 and an audio player 30. The button 20 disposed on the monitor 10 can be a touch sensor button while the audio player 30 is also arranged on the monitor 10 and is connected to the button 20. When users touch the button 20, the audio player 30 receives the signal and makes sounds so as to inform users for checking whether they press the button 20 intentionally or accidentally.

Figure 2:
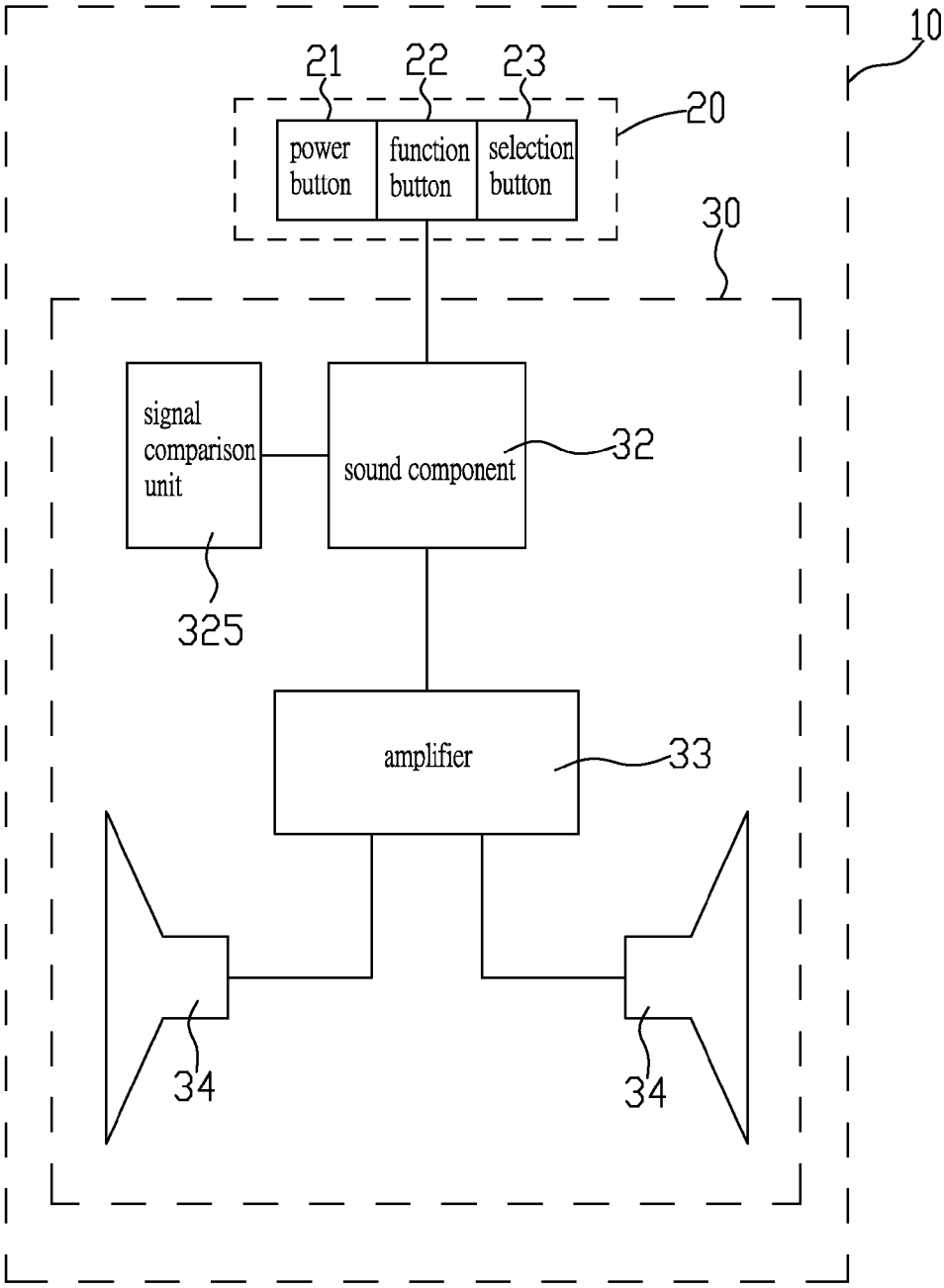
FIG. 2 is a schematic drawing of an embodiment in accordance with the present invention.

Refer to FIG. 2, the button 20 and the audio player 30 are disposed on the monitor 10. The button 20 consists of a power button 21, a function button 22, and at least a selection button 23 and is used for adjusting or setting the monitor 10 such as setting brightness, color contrast, size of the window, or on/off of the power. The audio player 30 is composed by a sound component 32 and a speaker 34. The sound component 32 connects to the button 20 while the speaker 34 connects to the sound component 32. The audio player 30 further includes a signal comparison unit 325 and an amplifier 33. The signal comparison unit 325 saves at least one sound file while the amplifier 33 electrically connects the sound component 32 with the speaker 34 for increasing the electrical output of an audio signal transmitted from the sound component 32 to the speaker 34.

When users press the button 20, the button receives a touch signal, initiates the monitor and simultaneously sends a signal to the sound component 32. According to the received signal, the sound component 32 make the signal comparison unit 325 output a corresponding a sound file. Thus the sound component 32 outputs a signal to the amplifier 33 and the amplifier 33 increases the electrical output of an audio signal that is sent to the speaker 34.

Figure 3:
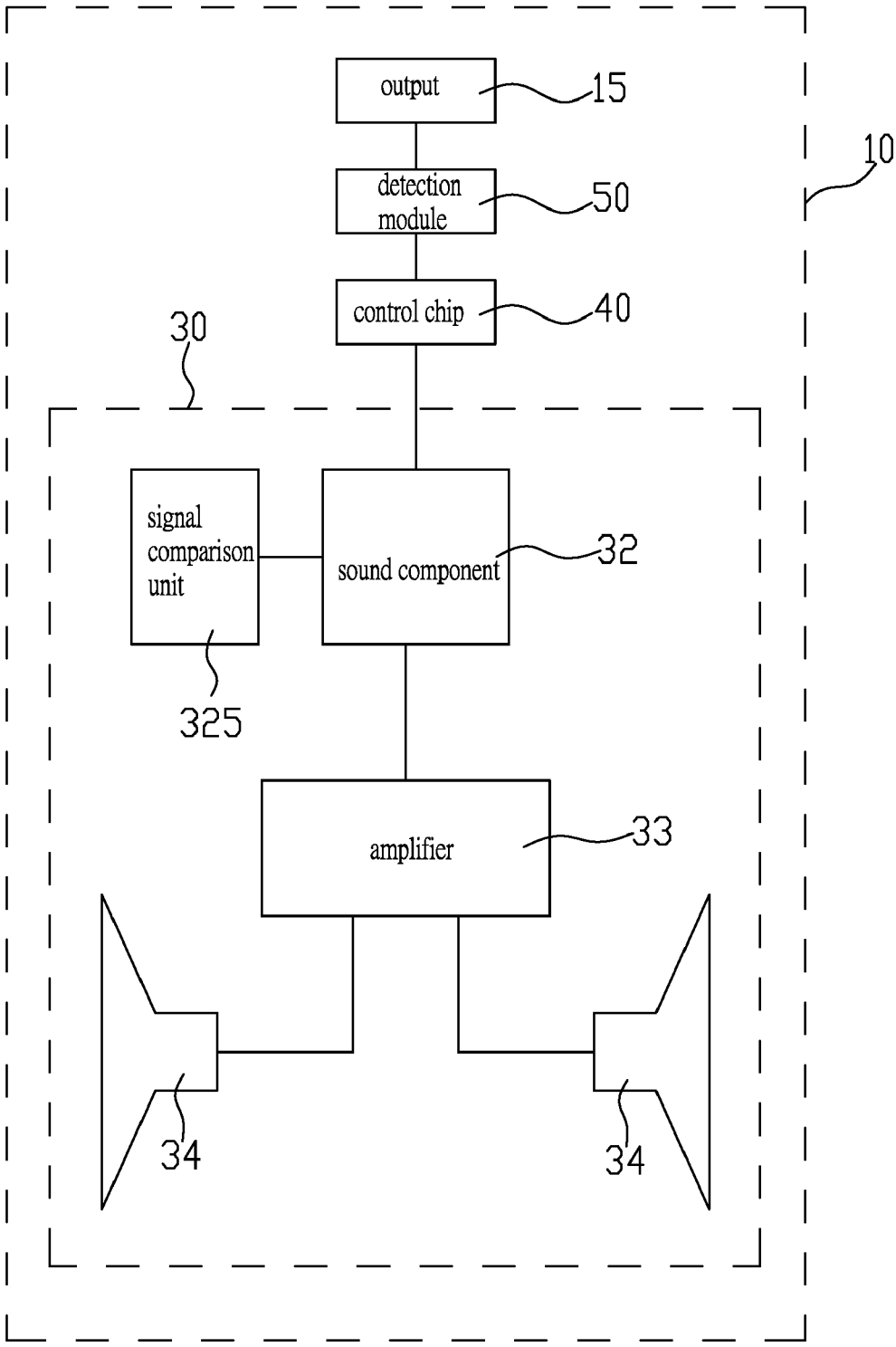
FIG. 3 is a schematic drawing of another embodiment in accordance with the present invention.

Refer to FIG. 3, the difference between this embodiment and above one is in that: this embodiment further comprising at least a control chip 40 electrically connected with the button 20 for control the monitor 10. The control chip 40 is also electrically connected with the audio player 30. When users set the monitor 10 improperly or the monitor 10 is out of order, the audio player 30 alarms so as to remind the user to check. Moreover, the monitor 10 further having a detection module 50 that is electrically connected with the control chip 40 for checking output image signal of an output end 15 of the monitor 10 and reminding users to deal with the problem when the monitor 10 is unable to output the image signal.

When users press the button 20 for adjusting settings of the monitor 10, the sound component 32 and the control chip 40 receives the signal. According to the signal, the sound component 32 makes the signal comparison unit 325 output a corresponding sound file. Thus the sound component 32 outputs an audio signal to the amplifier 33 and the amplifier 33 increases the electrical output of the audio signal that is sent to the speaker 34. As to the control chip 40, it sets up the monitor 10 or adjusts settings of the monitor 10. Once there is an error of output of the monitor 10, the detection module 50 detects the error and makes the control chip 40 send a detection signal to the audio player 30 to generate sounds.

For example, when users touch the function button 22 with intention to adjust or set the monitor 10, the audio player 30 make a sound while a function menu appears in a window of the monitor 10. Then users touch the selection button 23 and the audio player 30 again produces sounds. The user touch the selection button 23 to adjust the monitor 10 according to the content of the function menu and each touch make a sound.

In order to extend lifetime of the monitor 10, or improving the quality of the monitor 10, the control chip 40 is applied so as to make the functional menu of the monitor 10 have proper default value and warn users when there is improper setting of the monitor 10. For example, refer to brightness in the function menu for adjusting brightness of the image displayed in the monitor 10, some users like to adjust to the minimum or maximum brightness. With maximum brightness, lifetime of the monitor 10 is reduced while with minimum brightness, user's eyes are easy to get tired. The default brightness of general monitors ranges from 0 to 100. When users re-adjust the preset value that is over or under the default value of brightness, the control chip 40 sends a signal to the audio player 30 for generating sounds and reminding users to set properly.

Furthermore, when the monitor 10 stops working or has a breakdown without any output image signal, the detection module 50 detects the condition and makes the control chip 40 to send a detection signal to the audio player 30. Thus the audio player 30 make sounds so as to warn the user that the monitor 10 is in abnormal output status.

Figure 4:
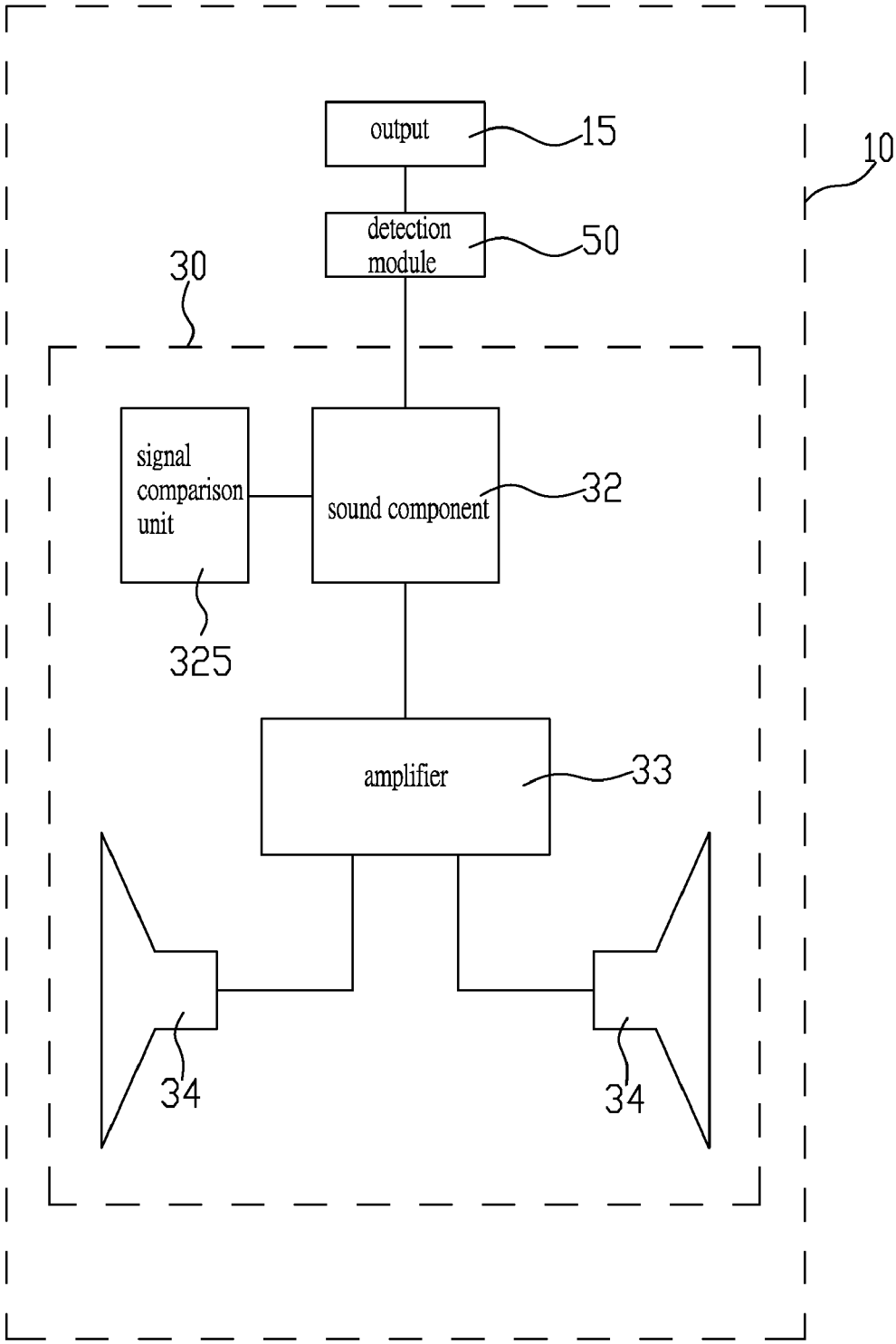
FIG. 4 is a schematic drawing of a further embodiment in accordance with the present invention.

Refer to FIG. 4, the difference between this embodiment and above one is in that: the detection module 50 is connected with the audio player 30. Thus the detection module 50 immediately sends a detection signal that makes the audio player 30 to make a warning sound. Therefore, once there is an error on output of the monitor 10, the monitor 10 instantly produces an alarm sound so as to warn the user and make the user deal with the error as soon as possible.

In summary, a monitor with reminder sounds includes a monitor, at least a button and an audio player. The button is connected with the audio player. When an user touches the button, the audio player receives a signal and make sounds. The monitor further having a detection module that checks an output image signal of the monitor. When the detection module detects errors of the output image signal, it transmits a detection signal to the audio player so as to make the audio player generate sounds. Thus the user is reminded that whether the button is pressed precisely. Moreover, when there is an error on output of the monitor, the user is warned by the reminder sound. Thus the present invention provides users more convenience of use.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A monitor with reminder sounds comprising:

a monitor;

at least one button disposed on the monitor, corresponding to a function of the monitor, the button initiating the corresponding function responsive to being touched;

an audio player arranged on the monitor and connected with the button a signal being sent to the audio player for initiating the audio player to make a sound responsive to the button being touched and the corresponding function being initiated; and a detection module coupled to the audio player, the detection module checking an output image signal of the monitor and outputting a signal responsive to an absence of the image signal being detected, wherein the audio player generates a sound responsive to the absence of the image signal detected by the detection module.

2. The monitor with reminder sounds as claimed in claim 1, wherein the button is a touch sensor button.

3. The monitor with reminder sounds as claimed in claim 1, wherein the audio player having a sound component connected with the button; and a speaker connected with the sound component.

4. The monitor with reminder sounds as claimed in claim 3, wherein the audio player further having an amplifier that is electrically connected with the sound component and the speaker.

5. The monitor with reminder sounds as claimed in claim 1, wherein the audio player having a signal comparison unit.

6. The monitor with reminder sounds as claimed in claim 1, further comprising a control chip electrically connected with the button, the detection module and the audio player for control functions of the monitor, the control chip outputting a signal to the audio player to initiate an alarm signal responsive to settings of the monitor being improperly set by a user.

7. The monitor with reminder sounds as claimed in claim 1, wherein the button is used to adjust functions of monitor's images.

8. The monitor with reminder sounds as claimed in claim 1, wherein the at least one button includes a power button.

9. The monitor with reminder sounds as claimed in claim 1, wherein the at least one button includes a function button.

10. The monitor with reminder sounds as claimed in claim 1, wherein the at least one button includes a selection button.

11. A monitor with reminder sounds comprising:

a monitor;

a control chip for controlling functions of the monitor; a button assembly disposed on the monitor and coupled to the control chip, the button assembly comprising at least one button corresponding to a function of the monitor, the button initiating the corresponding function of the monitor responsive to being touched;

a detection module coupled to the control chip for checking output image signals of the monitor; and an audio player coupled to the control chip for outputting a sound corresponding to the function of the monitor being initiated, the audio player generating a sound responsive to a detection signal output from the control chip when the detection module detects an absence of the image signals being detected, the audio player generating a sound responsive to an output signal from the control chip corresponding to a setting of the monitor being improperly set by a user.

12. The monitor with reminder sounds as claimed in claim 11, wherein the audio player having a sound component connected with the button; and a speaker connected with the sound component.

13. The monitor with reminder sounds as claimed in claim 12, wherein the audio player further having an amplifier that is electrically connected with the sound component and the speaker.

14. The monitor with reminder sounds as claimed in claim 11, wherein the button assembly is used to adjust functions of monitor's images.

15. The monitor with reminder sounds as claimed in claim 11, wherein the button assembly includes a power button.

16. The monitor with reminder sounds as claimed in claim 11, wherein the button assembly includes a function button.

17. The monitor with reminder sounds as claimed in claim 11, wherein the button assembly includes a selection button.

* * * * *